United States Patent [19]

Dowe

[11] Patent Number: 4,659,881

[45] Date of Patent: Apr. 21, 1987

[54] MULTIDOME MULTISTAGE SWITCH ASSEMBLY

[75] Inventor: David R. Dowe, Rochester, N.Y.

[73] Assignee: Eastman Kodak Company, Rochester, N.Y.

[21] Appl. No.: 822,567

[22] Filed: Jan. 27, 1986

[51] Int. Cl.[4] ..... H01H 3/12

[52] U.S. Cl. ..... 200/5 R; 200/67 R; 200/159 B; 200/340

[58] Field of Search ..... 200/5 A, 340, 159 B, 200/67 DB, 5 R, 67 R

[56] References Cited

U.S. PATENT DOCUMENTS

| | | | |
|---|---|---|---|
| 3,917,917 | 11/1975 | Murata | 200/5 A |
| 3,969,595 | 7/1976 | Johnson | 200/5 A |
| 4,343,973 | 8/1982 | Main | 200/159 |

FOREIGN PATENT DOCUMENTS

| | | | |
|---|---|---|---|
| 1361459 | 7/1974 | United Kingdom | 200/159 B |

*Primary Examiner*—A. D. Pellinen
*Assistant Examiner*—Morris Gimsburg
*Attorney, Agent, or Firm*—Roger A. Fields

[57] ABSTRACT

An electrical switch assembly has a pair of conducting resilient domes which snap inwardly to produce corresponding switching functions when downward pressure is applied at their respective centers and snap outwardly to produce opposite switching functions when the applied pressure is removed. The pair of domes are supported one within the other in spaced relation with their respective centers substantially in alignment. Pressure applying means, such as a push button, is mounted for movement in line with the aligned centers of the outer and inner domes to a first predetermined position to snap the outer dome inwardly and to a second predetermined position to snap the inner dome inwardly. The successive snapping actions of the two domes to produce corresponding switching functions provide respective stages of tactile feedback through the push button to the operator.

9 Claims, 5 Drawing Figures

MULTIDOME MULTISTAGE SWITCH ASSEMBLY

CROSS-REFERENCE TO A RELATED APPLICATION

Reference is made to commonly assigned, copending patent application Ser. No. 828,130, filed Jan. 7, 1986 in the name of David R. Dowe and entitled SINGLE DOME MULTISTAGE SWITCH ASSEMBLY.

BACKGROUND OF THE INVENTION

1. Field of the Invention

The invention relates generally to electrical switch assemblies and in particular to those switch assemblies which are capable of providing the operator with tactile feedback, i.e. touch perceived information that a switch assembly has been actuated from an open state to a closed state or vice versa.

2. Description of the Prior Art

Preferably, an electrical switch assembly should have a minimal number of parts and be small in size, and yet remain rugged, reliable and contaminant resistant. There have been many attempts to develop inexpensive reliable switch assemblies which have these capabilities. For example, in U.S. Pat. No. 4,343,973, granted Aug. 10, 1982, there is disclosed a multiple single-stage switch assembly. The switch assembly is a snap-acting push button type which includes a pair of electrically interconnected, conducting, snap action domes or convex discs disposed in side-by-side relation on a common base. Each of the snap action domes have center portions elevated above peripheral portions. This provides an over center snapping effect when downward pressure is applied to the center portions by respective push buttons. The operator pressing down on a push button can sense the over center snapping movement of the center portion of a dome. This sensation is commonly referred to as tactile feedback. When the operator releases the push button, however, the dome snaps back to its normal position. This snapping inwardly and outwardly of the dome is used to establish and break an electrical connection. Thus, the dome functions as a bi-state switching element.

While the multiple switch assembly disclosed in U.S. Pat. No. 4,343,973 is capable of providing tactile feedback to the operator to indicate switch closing, it has several problems. For example, arranging the pair of domes in side-by-side relation makes the multiple switch assembly unduly large and adds to the number of required parts, thereby increasing the cost to manufacture such switch assembly. Moreover, the side-by-side relation of the two domes necessitates a side-by-side relation of the associated push buttons. This, unfortunately, allows the operator to press the two push buttons in the wrong sequence.

3. The Cross Referenced Application

A commonly assigned application is cross-referenced above for information purposes. That application discloses a single dome, multi-stage switch assembly.

SUMMARY OF THE INVENTION

The above-described problems regarding multiple switch assemblies are believed to be solved by the invention. According to the invention, an electrical switch assembly has a pair of conducting resilient domes which snap inwardly to produce corresponding switching functions when downward pressure is applied at their respective centers and snap outwardly to produce opposite switching functions when the applied pressure is removed. The pair of domes are supported one within the other in spaced relation with their respective centers substantially in alignment. Pressure applying means, such as a push button, is mounted for movement in line with the aligned centers of the outer and inner domes to a first predetermined position to snap the outer dome inwardly and to a second predetermined position to snap the inner dome inwardly. The successive snapping actions of the two domes to produce corresponding switching functions provide respective stages of tactile feedback through the push button to the operator.

Consequently, with the invention, there is achieved a multiple switch assembly which is reduced in size, is substantially error free, and requires fewer parts as compared to prior art devices.

BRIEF DESCRIPTION OF THE DRAWINGS

The invention will be described in connection with the drawings, wherein.

DESCRIPTION OF THE PREFERRED EMBODIMENT

Figure 1:
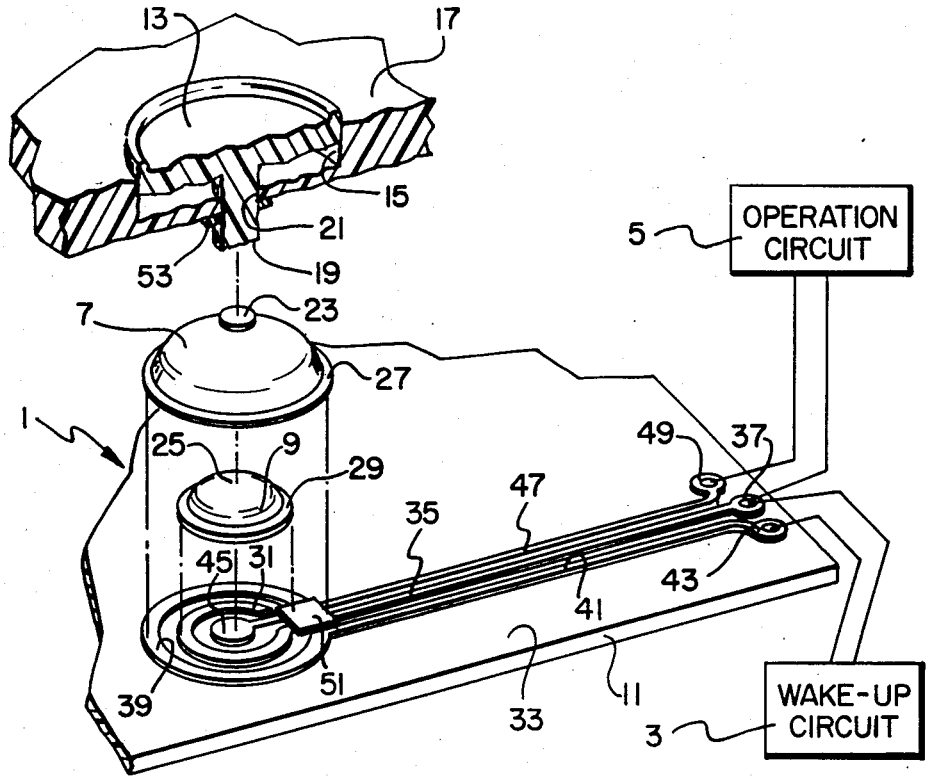
FIG. 1 is an exploded perspective view of an electrical switch assembly in accordance with a preferred embodiment of the invention.

Referring now to the drawings, and in particular to FIG. 1, there is shown an electrical switch assembly 1 which can be used in a wide variety of applications. According to the preferred embodiment, the switch assembly 1 is included in a photographic camera (not shown) to successively render conductive a known wake-up circuit 3 and a known operation circuit 5 both located within the camera body. Typically, the wake-up circuit 3 when rendered conductive readies a number of electrical components, such as LCD frame counter, a flash charger, a low light warning circuit, etc. The operational circuit 5 when rendered conductive performs a number of camera operations preparatory to exposure, such as automatic ranging, automatic focusing, measuring the level of ambient light, etc.

As shown in FIG. 1, the switch assembly comprises: a pair of resiliently flexible, electrically conducting, snap action domes 7 and 9; a discrete portion of a single-side printed circuit board 11; and a depressible plastic push button 13. Preferably, the push button 13 is disposed within a recess 15 in a top portion 17 of the camera body and includes a depending stem 19 which projects through an opening 21 at the bottom of the recess to engage the dome 7.

The pair of snap action domes 7 and 9 have respective center portions 23 and 25 elevated above respective peripheral portions 27 and 29. As is known in the art, this provides an over center snap action or collapsing effect when downward pressure is applied to the center portions 23, 25. Specifically, when downward movement of the center portions 23, 25 in response to the applied pressure exceeds respective predetermined positions, the domes 7,9 flex inwardly in a snapping or collapsing manner into reversed arc positions. The snap action domes are monostable, however, and therefore snap outwardly back to their normal original positions when the applied pressure is removed.

Figure 2:
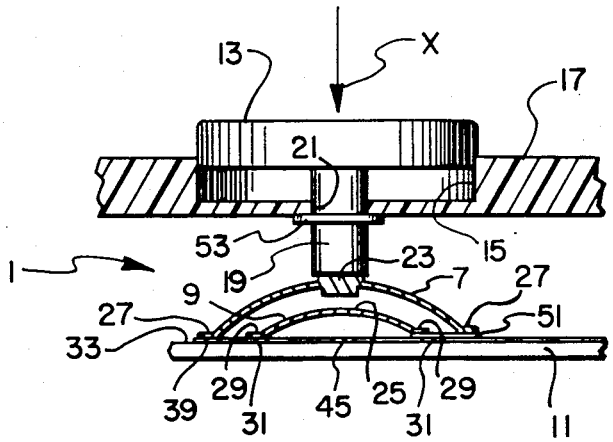
FIG. 2 is a sectional view of the switch assembly in its normal or idle state.
Figure 3:
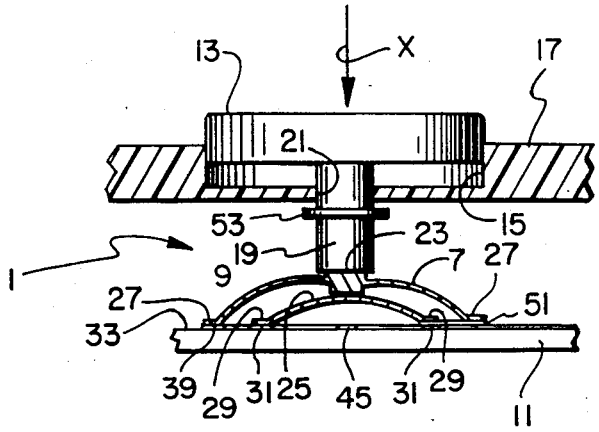
FIGS. 3 and 4 are sectional views of the switch assembly in successive states of operation.
Figure 4:
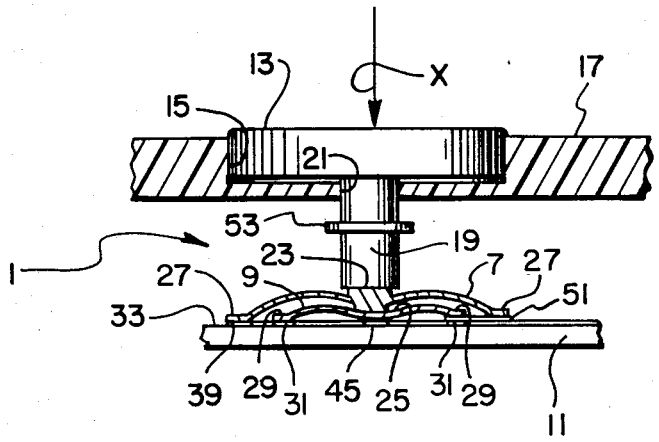

The printed circuit board 11 supports the two domes 7 and 9 one within the other, as shown in FIGS. 1 and 2, in closely spaced concentric relation with their center portions 23, 25 in alignment. The inner dome 9 is positioned for physical contact at its center portion 25 by the center portion 23 of the outer dome 7 when the outer dome is snapped inwardly, as depicted in FIG. 3. A fixed common contact pad 31 on the top side 33 of the circuit board 11 is conductively connected to the underside of the peripheral portion 29 of the inner dome 9. The common contact pad 31 has a lead 35 which ends in a terminal 37 leading to the wake-up and operation circuits 3 and 5. A first fixed switch contact pad 39 on the top side 33 of the circuit board 11 is conductively connected to the underside of the peripheral portion 27 of the outer dome 7. The first switch contact pad 39 has a lead 41 which ends in a terminal 43 leading to the wake-up circuit 3. A second fixed switch contact pad 45 on the top side 33 of the circuit board 11 is positioned beneath the center portion 25 of the inner dome 9 for physical contact by the center portion when the inner dome is snapped inwardly, as depicted in FIG. 4. The second switch contact pad 45 has a lead 47 which ends in a terminal 49 leading to the operation circuit 5. As shown in FIG. 1, an insulating sheet 51 covers the two leads 35, 47 of the common and second switch contact pads 31, 45 at a location where they should otherwise be bridged by the undersides of the peripheral portions 27 and 29 of the outer and inner domes 7 and 9. This is done to prevent the two domes 7 and 9 from normally establishing a shorting connection across the spaced leads 35 and 47.

The operation of the switch assembly 1 can best be understood by viewing FIGS. 2–4. When the push button 13 is depressed by a camera operator in the downward direction indicated by the arrow X in FIG. 2, the depending stem 19 of the push button moves in line with the center portions 23, 25 of the outer and inner domes 7,9. Initially, as shown in FIG. 3, the stem 19 moves to a first predetermined position to depress the outer dome 7 at its center portion 23 until the outer dome snaps inwardly into physical contact at its center portion with the center portion 25 of the inner dome 9. This provides an electrical connection between the common contact pad 31 and the first switch contact pad 39 to energize the wake-up circuit 3. Then, as shown in FIG. 4, the stem 19 moves to a second predetermined position to depress the outer dome 7 at its center portion 23 and, in turn, depress the inner dome 9 at its center portion 25 until the inner dome snaps inwardly into physical contact at its center portion with the second switch contact pad 45. This provides an electrical connection between the second switch contact pad 45 and the common contact pad 31 to energize the operation circuit 5.

Figure 5:
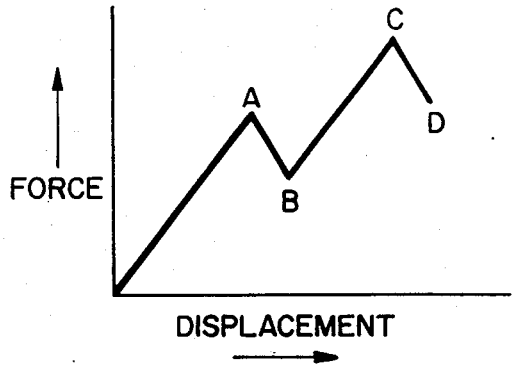
FIG. 5 is a graph illustrating the force-displacement characteristics of the switch assembly in its operation states.

FIG. 5 shows the force-displacement curve of the push button 13 as it is depressed in the downward direction X by the camera operator. From point A to point B on the curve, the outer dome 7 snaps inwardly, permitting the push button 13 to be despressed without increased finger pressure. Then, increased finger pressure moves the push button 13 to point C on the curve. From point C to point D on the curve, the inner dome 9 snaps inwardly, permitting the push button 13 to be depressed without increased finger pressure. The operator when applying finger pressure on the push button 13 can sense the successive snapping actions of the outer and inner domes 7 and 9. This sensation is commonly referred to as tactile feedback. Thus, the operator will be informed by tactile feedback first as to energization of the wake-up circuit 3 and then as to energization of the operation circuit 5.

When the finger pressure is removed from the push button 13, the outer and inner domes 7 and 9 snap outwardly to their normal original positions, as shown in FIG. 2, raising the push button 13. A rubber O-ring 53 on the stem 19 of the push button 13 limits upward movement of the push button by stopping against the underside of the top portion 17 of the camera body.

The invention has been described with reference to a preferred embodiment. However, it will be appreciated that variations and modifications can be effected within the ordinary skill in the art without departing from the scope of the invention. For example, three or more domes may be arranged one inside the other to effect a triple or greater stage switching assembly.

I claim:

1. An improved electrical switch assembly of the type wherein a pair of conducting resilient domes snap inwardly in response to applied pressure and snap outwardly when the pressure is removed, and wherein the improvement comprises:

means supporting said pair of domes one within the other in spaced relation;

first normally nonconducting circuit means rendered conductive when the outer one of said domes is snapped inwardly;

second normally nonconducting circuit means rendered conductive when the inner one of said domes is snapped inwardly; and pressure applying means movable to a first predetermined position to snap said outer dome inwardly, to render said first circuit means conductive, and to a second predetermined position to snap said inner dome inwardly, to render said second circuit means conductive, whereby respective stages of tactile feedback are provided by the snapping actions of the two domes in response to movement of said pressure applying means to its first and second positions.

2. The improvement as recited in claim 1, wherein said pressure applying means includes a depressible push button and means supporting said button for unidirectional movement to said first and second predetermined positions to successively snap said outer and inner domes inwardly.

3. The improvement as recited in claim 1, wherein said means supporting the outer and inner domes positions said inner dome for physical contact by said outer dome to enable pressure applied to the outer dome after that dome is snapped inwardly to snap the inner dome inwardly, and said pressure applying means includes a manually operated push member movable to said first and second predetermined positions for applying pressure to said outer dome.

4. The improvement as recited in claim 3, wherein said means supporting the outer and inner domes positions said two domes with their respective centers substantially in alignment, and said pressure applying means includes means supporting said push member for unidirectional movement in line with said centers of the two domes to said first and second predetermined positions.

5. An improved electrical switch assembly of the type wherein a pair of conducting resilient domes snap inwardly to produce corresponding switching functions when pressure is applied at their respective centers and snap outwardly to produce opposite switching functions when the applied pressure is removed, and wherein the improvement comprises:

means supporting said pair of domes one within the other in spaced relation with their respective centers substantially in alignment; and pressure applying means movable in line with the centers of the outer and inner domes to a first predetermined position to snap the outer dome inwardly, to produce a first switching function, and to a second predetermined position to snap the inner dome inwardly, to produce a second switching function, whereby respective stages of tactile feedback are provided by the snapping actions of the two domes in response to movement of said pressure applying means to its first and second positions.

6. An improved electrical switch assembly of the type wherein a pair of conducting resilient domes snap inwardly when pressure is applied at their respective centers and snap outwardly when the applied pressure is removed, and wherein the improvement comprises:

means supporting said pair of domes one within the other in spaced relation with their respective centers substantially in alignment and the inner dome positioned for physical contact by the outer dome when the outer dome is snapped inwardly;

a fixed common contact conductively connected to said inner dome;

a first fixed switch contact conductively connected to said outer dome;

a second fixed switch contact positioned beneath the center of said inner dome in spaced relation for physical contact by the inner dome when that dome is snapped inwardly; and pressure applying means movable in line with the centers of said outer and inner domes to a first predetermined position to snap the outer dome inwardly into physical contact with the inner dome, to connect said common contact and said first switch contact, and to a second predetermined position to snap the inner dome inwardly into physical contact with said second switch contact, to connect the common contact and the second switch contact, whereby respective stages of tactile feedback are provided by the snapping actions of the two domes in response to movement of said pressure applying means to its first and second positions.

7. The improvement as recited in claim 6, wherein said supporting means for the outer and inner domes includes a printed circuit board, said two domes being located on one side of said circuit board, and said common contact and said first and second switch contacts being located on the same side.

8. An improved electrical switch assembly of the type wherein a pair of resiliently flexible conducting domes snap inwardly when pressure is applied at their respective centers and snap outwardly when the applied pressure is removed, and wherein the improvement comprises:

means supporting said pair of domes one within the other in closely spaced concentric relation with their respective centers substantially in alignment and the inner dome positioned for physical contact by the outer dome when the outer dome is snapped inwardly;

a fixed common contact conductively connected to said inner dome along a peripheral portion of that dome;

a first fixed switch contact conductively connected to said outer dome along a peripherial portion of that dome;

a second fixed switch contact positioned beneath the center of said inner dome in spaced relation for physical contact by the inner dome when that dome is snapped inwardly; and pressure applying means depressable in line with the centers of said outer and inner domes to a first predetermined position to first depress the outer dome at its center until that dome snaps inwardly into physical contact with the inner dome, to connect said common contact and said first switch contact, and to a second predetermined position to then depress the outer dome at its center to similarly depress the inner dome until the inner dome snaps inwardly into physical contact with said second switch contact, to connect the common contact and the second switch contact, whereby respective stages of tactile feedback are provided by the snapping actions of the two domes in response to movement of said pressure applying means to its first and second positions.

9. In a photographic camera of the type having first and second normally nonconductive circuit means which when individually rendered conductive enable certain camera operations, an electrical switch assembly comprising:

a pair of conducting resilient domes which snap inwardly to render said first and second circuit means conductive when pressure is applied at their respective centers and snap outwardly to render the first and second circuit means nonconductive when the applied pressure is removed;

means supporting said pair of domes one within the other in spaced relation with their respective centers substantially in alignment; and pressure applying means movable in line with the centers of the outer and inner domes to a first predetermined position to snap the outer dome inwardly, to render said first circuit means conductive, and to a second predetermined position to snap the inner dome inwardly, to render said second circuit means conductive, whereby respective stages of tactile feedback are provided by the snapping actions of the two domes in response to movement of said pressure applying means to its first and second positions.

* * * * *